United States Patent [19]

Tamburini

[11] 4,260,015

[45] Apr. 7, 1981

[54] SURFACE CONDENSER

[75] Inventor: Primo Tamburini, Lisse, Netherlands

[73] Assignee: Organisation Europeenne de Recherches Spatiales, Paris, France

[21] Appl. No.: 76,747

[22] Filed: Sep. 18, 1979

[30] Foreign Application Priority Data

Oct. 5, 1978 [BE] Belgium ..... 190929

[51] Int. Cl.[3] ..... F28B 9/08; F28B 9/02

[52] U.S. Cl. ..... 165/110; 165/147; 165/167; 165/170

[58] Field of Search ..... 165/147, 110, 146, 170, 165/166, 167

[56] References Cited

U.S. PATENT DOCUMENTS

| | | | |
|---|---|---|---|
| 412,088 | 10/1889 | Haubtman | 165/147 |
| 1,958,899 | 5/1934 | MacAdams | 165/146 |
| 3,232,341 | 2/1966 | Woodworth | 165/146 |
| 3,362,468 | 1/1968 | Olson | 165/110 |

FOREIGN PATENT DOCUMENTS

| | | | |
|---|---|---|---|
| 201321 | 2/1908 | Fed. Rep. of Germany | 165/110 |
| 308648 | 12/1916 | Fed. Rep. of Germany | 165/110 |
| 2708657 | 9/1977 | Fed. Rep. of Germany | 165/110 |
| 1202388 | 1/1960 | France | 165/110 |

*Primary Examiner*—Sheldon J. Richter

*Attorney, Agent, or Firm*—Young & Thompson

[57] ABSTRACT

A surface condenser particularly suitable for being used in a zero gravity environment and which is easy to be manufactured. It comprises at least one pair of coextensive elements spaced apart from each other to form a relatively narrow gap therebetween, said gap having a width which is tapered from the outer ends of said elements towards a defined portion thereof. Peripheral distributor means extends along the outer ends of the elements and has its interior space in communication with the gap at the larger width side thereof, said distributor means having an inlet for the vapor to be condensed. Collector means is provided in communication with the interior space of the gap at the smaller width side thereof for collecting the condensed liquid.

4 Claims, 6 Drawing Figures

SURFACE CONDENSER

FIELD OF THE INVENTION

The present invention relates to a condenser apparatus specially intended for the condensation of high temperature vapor and removal of heat therefrom in space applications.

A first attractive application for such a condenser is a liquid/vapor heat transport system. The basic principle of such a two-phase system is vaporizing a liquid in an evaporator which absorbs the latent heat, thereby increasing the local pressure, and at a distant location condensing the vapor in a condenser where the latent heat is released at a temperature very close to that of the evaporator. The condensed liquid is then returned to the evaporator thereby to complete the cycle.

Another application is a closed-loop Rankine cycle powerplant in which a liquid metal, e.g. potassium, is circulated in a closed loop, vaporized by the addition of energy from a source and conducted through a fluid turbine wherein energy is extracted in the form of useful work, with the vapor subsequently being exhausted into a condenser. Additional energy is extracted in the condenser wherein the vapor is condensed into liquid and the condensed liquid is collected for subsequent return to the heat source.

Using such systems in space applications presents a major problem in that sense that in the absence of gravity, i.e. in a weightless environment, which is the operating condition in space, the liquid and the vapor are difficult to separate from each other and the condenser design must guarantee that condensed liquid is removed from the condensation walls and is collected in one mass free of vapor bubbles at the condenser outlet.

Conventional condenser design utilizes capillary forces or centrifugal forces to effect liquid/vapor separation. Another design as disclosed in U.S. Pat. No. 3,362,468 uses tapered tubes whereto the vapor is introduced at their larger diameter end and wherefrom the condensed liquid is removed at their smaller diameter end. Condensation is effected entirely within the tapered tubes. Such a condenser design is suitable for being used in a zero gravity environment. However, manufacturing problems arise which are connected with the requirements for avoiding the interface between vapor and liquid becoming unstable for a range of disturbances. In effect, in the tapered tube design the tube diameter and the condensate thickness have to be adapted to the hydrodynamic parameters with a given fluid.

Furthermore, this known design with tapered tubes does not allow versatile adaptations to the usual needs in connection with the way of implementing the heat sink, that is the way of removing the heat from the condenser apparatus.

The above problems are solved by the improved condenser design in accordance with the invention.

SUMMARY OF THE INVENTION

It is thus an object of this invention to provide a surface condenser particularly suitable for the condensation of high temperature vapor in a zero gravity environment.

A further object of the invention is to provide a surface condenser which is easy to be manufactured and which is lightweight.

A still further object is to provide a surface condenser which allows versatile adaptations to the various needs in connection with the way of implementing the heat sink.

In accordance with this invention, the condenser apparatus comprises at least one pair of coextensive elements spaced apart from each other to form a relatively narrow gap therebetween, said gap having a width which is tapered from the outer ends of said elements towards a defined portion thereof. Peripheral distributor means extends along the outer ends of the elements and has its interior space in communication with the gap at the larger width side thereof, said distributor means having an inlet for the vapor to be condensed. Collector means is provided in communication with the interior space of the gap at the smaller width side thereof for collecting the condensed liquid.

DESCRIPTION OF EXEMPLARY EMBODIMENTS

Figure 1:
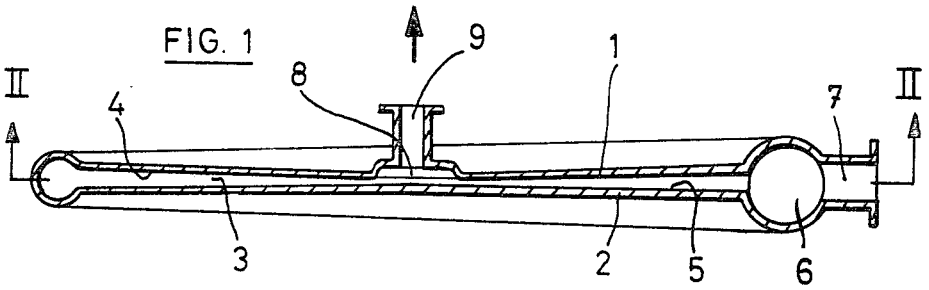
FIG. 1 is a sectional view of an exemplary embodiment of the condenser in accordance with the invention.

As illustrated in FIG. 1 the condenser of the invention comprises a pair of coextensive plate elements 1,2 spaced apart from each other to form a relatively narrow gap 3 therebetween. The elements may be of any shape, for instance a circular shape as shown illustratively in FIG. 2. The width of the gap 3 is not uniform but gradually reduces from the outer ends of the elements 1,2 towards a defined portion thereof, for instance the central portion thereof as illustrated in the drawing. The gap width is sized taking into account the type of fluid and the system parameters. At its outer end the gap 3 is connected to a peripheral distributor 6 for the vapor to be condensed. The distributor 6 has an inlet 7 for the vapor. In an exemplary embodiment the plate elements have a diameter of 120 mm with a gap therebetween varying from 1 mm at the outer end to 0.5 mm at the inner end.

Figure 2:
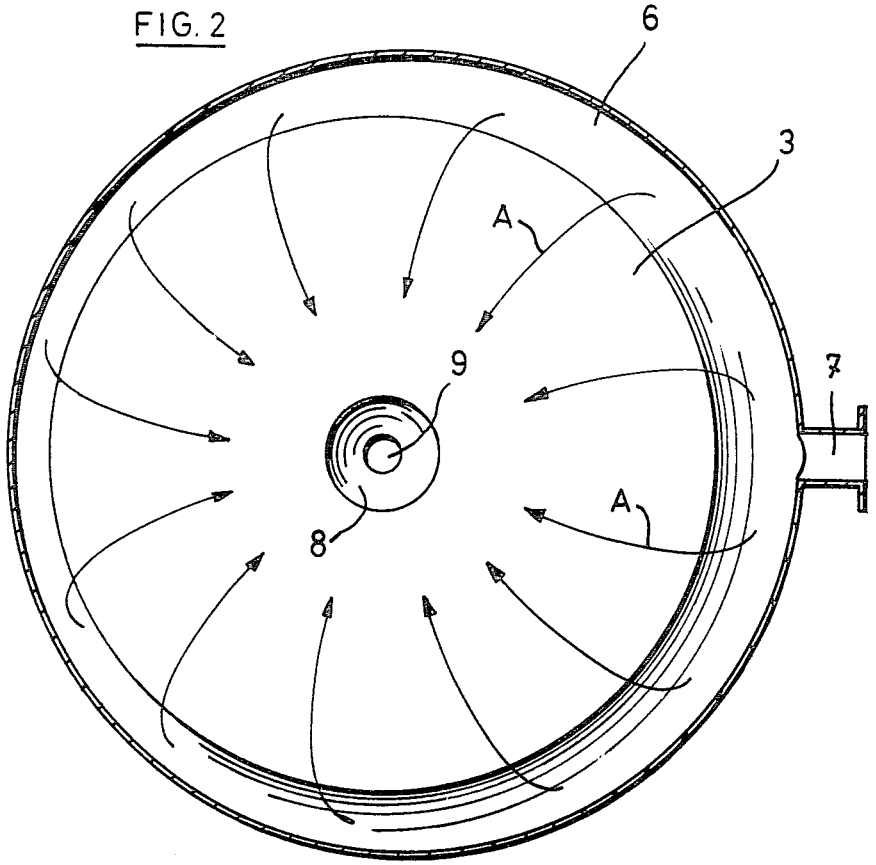
FIG. 2 is a view along line II—II of FIG. 1.

The distributor 6 introduces the vapor into the gap 3 at the larger section area side thereof. The arrows A on FIG. 2 show the flow of vapor through the gap. The vapor condenses on the condensation surfaces 4,5 which bound the gap 3 and the droplets of condensed liquid, when they have grown enough to wet both condensation surfaces, are pulled by surface tension towards the central area 8 of the surfaces 4 and 5 where the gap has its smaller width. The condensed liquid assembles there substantially free of vapor bubbles and it is removed from that central area 8 of the plates through outlet pipe 9.

Radially extending fins (not shown) may be provided on the condensation surfaces for ensuring the structural integrity of the condenser and improving the flow distribution and the heat transfer rate.

The condenser in accordance with the inventive design can be manufactured much more easily than be known design with tapered tubes. Furthermore, it permits an easy and versatile adaptation to the various needs with respect to the way of removing the heat from the condenser.

The most conventional way of using the condenser directly as a radiator is achieved by properly painting the outer surfaces of the elements 1 and 2.

Figure 3:
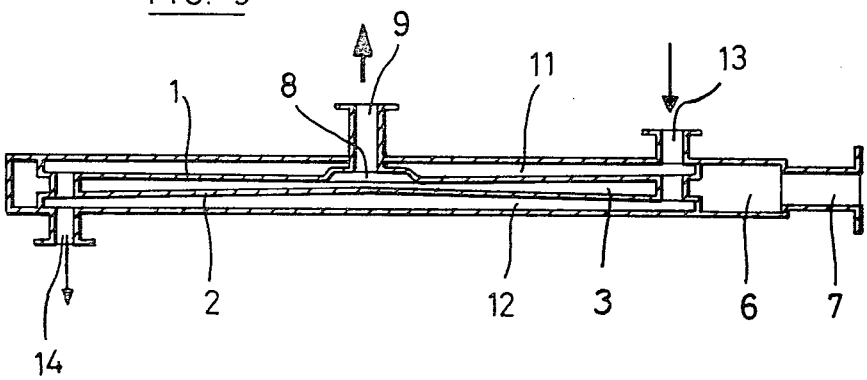
FIG. 3 is a sectional view of a second embodiment of the condenser according to the invention.

In cases where the heat has to be removed by heat exchange with a coolant fluid, the condenser design of the invention can be easily adapted for providing a distribution system for the coolant fluid. FIG. 3 illustrates a single layer condenser heat exchanger arrangement. On this figure the reference numerals 1,2,3,6,7,8 and 9 designate similar parts to those shown on FIG. 1. The numerals 11 and 12 designate lateral passages formed adjacent the external faces of elements 1 and 2. Said lateral passages 11 and 12 are connected to a coolant fluid inlet 13 and a coolant fluid outlet 14. The heat exchange between the condensed fluid in the tapered passage 2 and the coolant fluid in the lateral passages 11,12 occurs through the elements 1,2.

Figure 4:
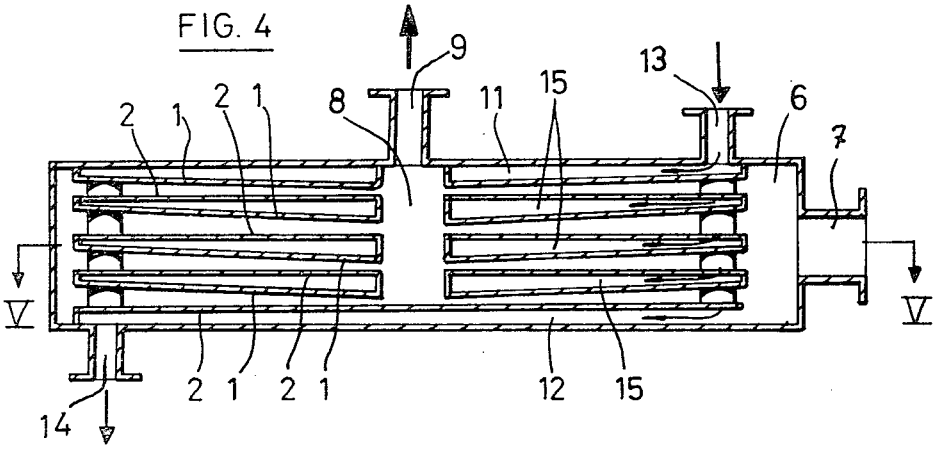
FIG. 4 is a sectional view of a third embodiment of the condenser according to the invention.
Figure 5:
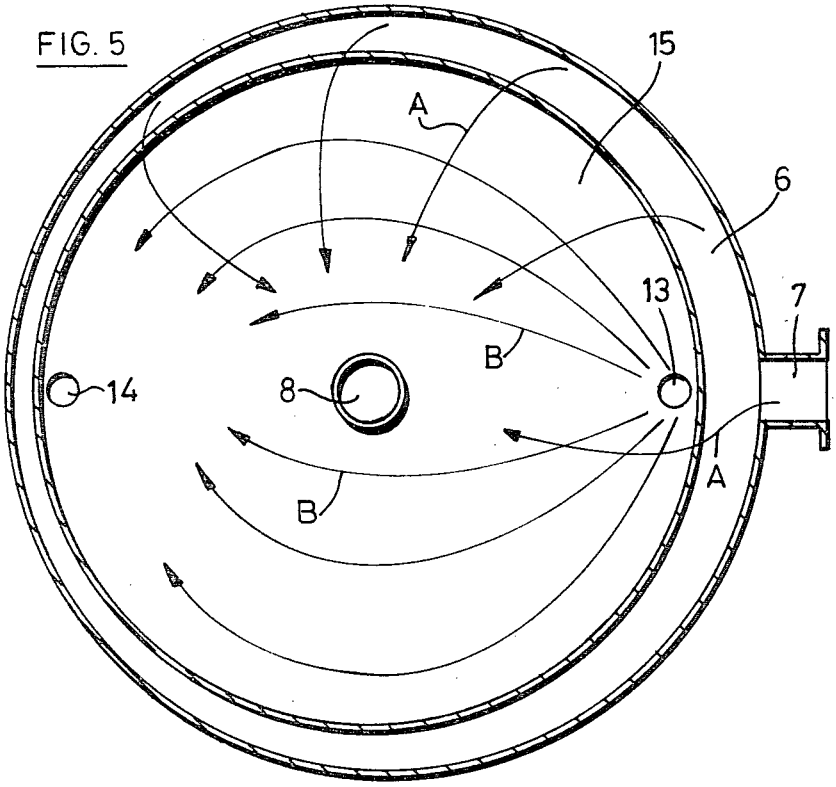
FIG. 5 is a view along line V—V of FIG. 4.

FIGS. 4 and 5 illustrate another embodiment, viz. a multilayer condenser arrangement. On FIG. 4 there are shown a plurality of pairs of plate elements 1,2 with the tapered gaps 3, the peripheral distributor 6, the central collector 8 and the lateral passages 11 and 12. Between the adjacent pairs of elements 1 and 2 there are provided intermediate passages 15 which communicate with the inlet 13 and outlet 14 for the coolant fluid. On FIG. 5, the arrows denoted A show the flow of vapor and the condensate and the arrows B show the flow of the coolant fluid. As a variation the lateral passages 11,12 can be omitted in an embodiment like that shown in FIG. 4.

Figure 6:
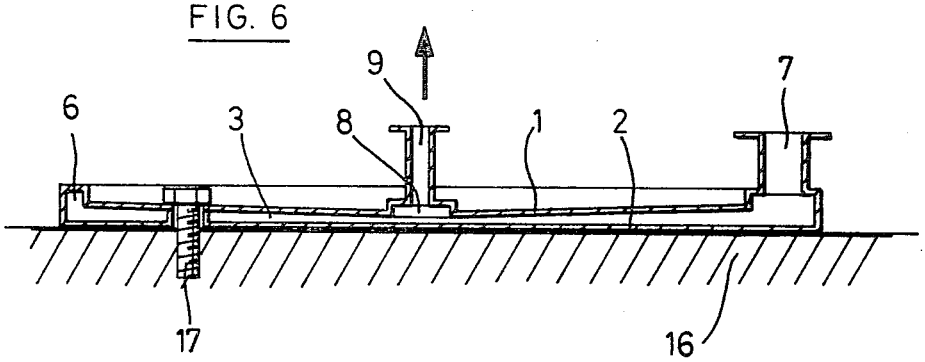
FIG. 6 is a sectional view of a fourth embodiment of the condenser according to the invention.

In applications where the heat has to be removed through a cold plate, one of the elements 1,2 can be bolted directly onto said cold plate as shown schematically in FIG. 6. The cold plate is designated by the reference numeral 16. The condenser element 2 is fixed onto the cold plate 16 by means of bolts 17. The contact conductance between the element 2 and the cold plate 16 can be improved by using a suitable interface filler material at the juncture of the bolted elements.

What is claimed is:

1. Condenser apparatus comprising:

at least one pair of coextensive elements spaced apart from each other to form a relatively narrow gap therebetween, said gap having a width which is tapered from the outer ends of said elements towards a defined portion thereof;

peripheral distributor means extending along the outer ends of said elements and having its interior space in communication with the said gap at the larger width side thereof, said distributor means having an inlet for the vapor to be condensed; and collector means for collecting the condensed liquid at said defined portion of the elements, said collector means being in communication with the interior space of the gap at the smaller width side thereof.

2. A condenser apparatus according to claim 1, wherein there are provided means for creating passages adjacent the external surfaces of said elements, said passages being connected to a coolant fluid inlet and a coolant fluid outlet for permitting the circulation of the coolant fluid in heat exchange relation with the condensed fluid.

3. A condenser apparatus according to claim 1, wherein there are provided a plurality of pairs of spaced apart coextensive elements, the gap between the elements in each pair having a width which is tapered from the outer ends of the elements towards a defined portion thereof, the gaps being connected at their larger width side to said peripheral distributor means and at their smaller width side to said collector means.

4. A condenser apparatus according to claim 3, further comprising means for creating passages adjacent the external surfaces of said elements, said passages being connected to a coolant fluid inlet and a coolant fluid outlet for permitting the circulation of the coolant fluid in heat exchange relation with the condensed fluid.

* * * * *